US005887317A

United States Patent [19]

Baker

[11] Patent Number: 5,887,317

[45] Date of Patent: Mar. 30, 1999

[54] ADJUSTABLE LOCKING HINGE

[76] Inventor: Eldon R. Baker, 2205 Hilltop Dr. #1000, Redding, Calif. 96007

[21] Appl. No.: 953,404

[22] Filed: Oct. 17, 1997

[51] Int. Cl.[6] ..... E05D 11/10

[52] U.S. Cl. ..... 16/329; 16/273; 16/340

[58] Field of Search ..... 16/329, 322, 340, 16/342, 353, 273, 274

[56] References Cited

U.S. PATENT DOCUMENTS

| | | | |
|---|---|---|---|
| 872,650 | 12/1907 | Gilroy . | |
| 1,027,716 | 5/1912 | Fletcher | 16/273 |
| 1,612,237 | 12/1926 | Thornton | 16/329 |
| 3,874,029 | 4/1975 | McCullough . | |
| 4,117,567 | 10/1978 | Shimizu | 16/329 |
| 4,351,085 | 9/1982 | Suska | 16/273 |
| 4,353,146 | 10/1982 | Brockhaus | 16/273 |
| 4,807,330 | 2/1989 | Gomes | 16/273 |
| 4,829,633 | 5/1989 | Kassner . | |
| 4,964,193 | 10/1990 | Rommelfaenger et al. | 16/273 |
| 4,999,937 | 3/1991 | Bechtold . | |
| 5,125,131 | 6/1992 | Leblanc . | |
| 5,173,993 | 12/1992 | Baker . | |
| 5,402,150 | 3/1995 | Stiles . | |

FOREIGN PATENT DOCUMENTS

| | | | |
|---|---|---|---|
| 090798 | 2/1968 | France | 16/273 |
| 552546 | 11/1957 | Italy . | |
| 502276 | 3/1939 | United Kingdom | 16/340 |

*Primary Examiner*—Chuck Y. Mah
*Attorney, Agent, or Firm*—Richard C. Litman

[57] ABSTRACT

An adjustable locking hinge for holding a door either completely or partially open. The adjustable locking hinge has an adjustable friction resistance and allows retention of the door at any desired angle. The hinge includes two hinge leaves with knuckles in an intermeshing relationship with each other, and a hinge pin that extends through the knuckles that is axially shiftable to locked and unlocked positions. Two pins extend upwardly from opposite sides of a base element and engage a sprocket plate mounted on the hinge pin, in the locked position. In the locked position, the resistance to move the door is adjusted by an actuating mechanism. A protective cap is removably attached to the base element, and covers the components of the locking mechanism. The protective cap has a central aperture through which the top portion of the actuating mechanism extends. The lower portion of the hinge pin includes an axial bore with an end button press fit therein. The hinge pin is shifted downward to the locked position by pressing down on the top portion of the actuating mechanism, and the hinge pin is shifted upward to the unlocked position by pressing the end button upward. A sleeve extends through the knuckles, and has an internal diameter that is approximately only 4/1000" larger than the external diameter of the hinge pin. These close tolerances result in reduced wear and tear on the hinge. To avoid inadvertent movement of the hinge pin, the hinge further includes a position retention mechanism.

15 Claims, 4 Drawing Sheets

ADJUSTABLE LOCKING HINGE

BACKGROUND OF THE INVENTION

1. Field of the Invention

The present invention relates to a locking hinge assembly which can be set to hold a door in a predetermined position. More specifically, the locking hinge includes a sleeve containing an axially moveable hinge pin with a sprocket plate, that locks the hinge to maintain the door in specific position. The sleeve reduces the amount of slack in the hinge, thereby increasing the life of the hinge.

2. Description of the Related Art

Several different types of locking hinges have been disclosed in the prior art. None of the prior art devices, however, provide a hinge that: retains a door at any desired angle; permits adjustment of the amount of friction exhibited during opening and closing of the door; and has a sleeve for reducing slack and increasing the usable life of the hinge. The most pertinent prior art is the applicant's own U.S. Pat. No. 5,173,993, issued on Dec. 29, 1992. This patent discloses an adjustable locking door hinge that retains a door at any desired angle, permits adjustment of the amount of friction exhibited during opening and closing of the door, and operates in substantially the same manner as the present invention. Therefore, U.S. Pat. No. 5,173,993 is hereby incorporated by reference. U.S. Pat. No. 872,650, issued on Dec. 3, 1907 to Gilroy discloses a fluid operated locking hinge with an axially moveable hinge pin that locks the hinge in a closed position. U.S. Pat. No. 3,874,029, issued on Apr. 1, 1975 to McCullough discloses a locking hinge having an axially moveable hinge pin that locks the hinge in a several positions. U.S. Pat. No. 4,829,633, issued on May 16, 1989 to Kassner, shows a vehicle door hinge with an adjustable door check. U.S. Pat. No. 4,999,937, issued on Mar. 19, 1991 to Bechtold, teaches a panel sign having a ratchet hinge with an axially moveable hinge pin for engaging and disengaging the ratchet. U.S. Pat. No. 5,125,131, issued on Jun. 30, 1992 to Leblanc teaches a hinge locking mechanism with a fluid operated action. The entire device is disposed within a sleeve housing to form a cylinder and piston operating mechanism. U.S. Pat. No. 5,402,150, issued on Mar. 28, 1995, to Stiles shows a pointing device with a selectively lockable pivot. British Patent Specification No. 502,276, dated Mar. 15, 1939, shows a locking hinge assembly with an axially displaceable hinge pin. Italian Patent No. 552546, issued Dec. 6, 1956, shows a locking hinge assembly. The top portion of the hinge is fitted with a slotted aperture which operates in conjunction with a lock-engaging lever to lock the hinge in a plurality of positions.

None of the above inventions and patents, taken either singularly or in combination, is seen to describe the instant invention as claimed. Thus an adjustable locking hinge solving the aforementioned problems is desired.

SUMMARY OF THE INVENTION

It is often desired to hold a door either completely or partially open. Physical door stops, however, are inconvenient and must be moved to different locations to hold the door open at different positions. It is also convenient to be able to adjust the frictional resistance presented by the hinges of the door, to accommodate drafts or out-of-plumb installations wherein the door tends to open of close by the weight of the door itself.

The present invention provides an adjustable locking hinge that has an adjustable friction resistance and allows retention of the door at any desired angle. The hinge includes two hinge leaves with knuckles in an intermeshing relationship with each other. A hinge pin extends through the knuckles, and is axially shiftable to locked and unlocked positions. A locking mechanism surrounds the upper portion of the hinge pin and includes a base element welded to the top of one of the hinge leaves. The base element includes two pins that extend upwardly from opposite sides of the base element. A sprocket plate mounted on the hinge pin, is axially shiftable with the hinge pin, and includes a plurality of peripheral teeth that are engaged by the pins in the locked position. In the unlocked position the hinge pin and sprocket plate are moved upwards, and the sprocket plate is disengaged from the pins.

When the hinge pin is in the locked position, the resistance to move the door is adjusted by an actuating mechanism. A pressure plate is keyed to the hinge pin above the sprocket plate. The sprocket plate is supported on the hinge pin from underneath by a shoulder portion on the upper portion of the hinge pin. The sprocket plate is not keyed to the hinge pin, and rotates frictionally with respect to the hinge pin. The upper portion of the hinge pin includes a threaded section with a hex acorn nut thereon. Between the hex acorn nut and the pressure plate is a Belleville washer that presses the pressure plate against the sprocket plate, and thereby applies a biasing force that resists arcuate displacement between the sprocket plate and the hinge pin. The resistance to move the door is adjusted by tightening and loosening the hex acorn nut on the hinge pin, to change the compression of the Belleville washer and thereby adjust the biasing force. Fiber washers are mounted between the shoulder portion and the sprocket plate and between the sprocket plate and the pressure plate. The fiber washers provide a smooth surface to reduce binding when the sprocket plate rotates relative to the hinge pin.

The base element also includes a central bore through which the hinge pin extends, and a circular shelf surrounding the central bore. The shoulder portion contacts the shelf when the hinge pin is in the lowered, locked position and thereby limits the downward axial shifting of the hinge pin with respect to the hinge. The lower portion of the hinge pin includes an axial bore with an end button press fit therein. The end button has a cylindrical portion and a circular plate portion with an external diameter that is substantially equal to the external diameters of the knuckles of the first and second leaves, thereby providing a flush surface therebetween, and limiting the upward travel of the hinge pin. The end button may include a second cylindrical portion between the first cylindrical portion and the circular plate portion to allow the end button to act as an extension of the hinge pin.

A major advantage of the present invention is the use of a sleeve that extends through the knuckles. The internal diameter of the sleeve is approximately $4/1000''$ larger than the external diameter of the hinge pin. These close tolerances result in reduced wear and tear on the hinge and the components of the locking mechanism. The sleeve is press fit into the knuckles of one of the hinge leaves, with the internal diameter of the knuckles of the other hinge leaf being slightly larger than the external diameter of the sleeve to allow rotation therebetween. The hinge pin extends through the sleeve and is nonrotatably fixed relative to the second hinge leaf and the sleeve. One of the knuckles the sleeve is press fit into, includes two axially extending slots on opposite sides thereof. The sleeve also includes two axially extending slots that align with the slots in the knuckle. A transverse bore in the hinge pin receives a dowel that projects into the axially extending slots of the sleeve and the axially extending slots of the knuckle.

To avoid inadvertent movement of the hinge pin, the hinge further includes a position retention mechanism comprised of a transverse bore in the hinge pin. Within the transverse bore, a small coil spring urges a ball bearing against the internal surface of the sleeve. This arrangement creates friction between the hinge pin and the sleeve, thereby resisting axial shifting therebetween. In previous designs without sleeve, the loose construction required indentations in the internal surface of knuckle, for the ball bearing to "lock" into. The close tolerances provided by the use of the sleeve, however, results in a tighter and more secure fit between the sleeve and the hinge pin, and the indentations are unnecessary. The hinge also includes a protective cap removably attached to the base element, and covering the components of the locking mechanism. The protective cap has a central aperture through which the top portion of the hex acorn extends. This allows the hinge pin to be shifted downward to the locked position by pressing down on the top portion of the hex acorn nut. To unlock the hinge, the hinge pin is shifted upward to the unlocked position by pressing the end button upward.

Accordingly, it is a principal object of the invention to provide an adjustable locking hinge that holds a door either completely or partially open.

It is another object of the invention to provide an adjustable locking hinge wherein the frictional resistance presented by the hinges of the door can be adjusted.

It is a further object of the invention to provide a locking hinge with a sleeve closely fitted to an axially shiftable hinge pin, to reduce wear and tear on the components of the locking hinge.

It is an object of the invention to provide improved elements and arrangements thereof in an adjustable locking hinge for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
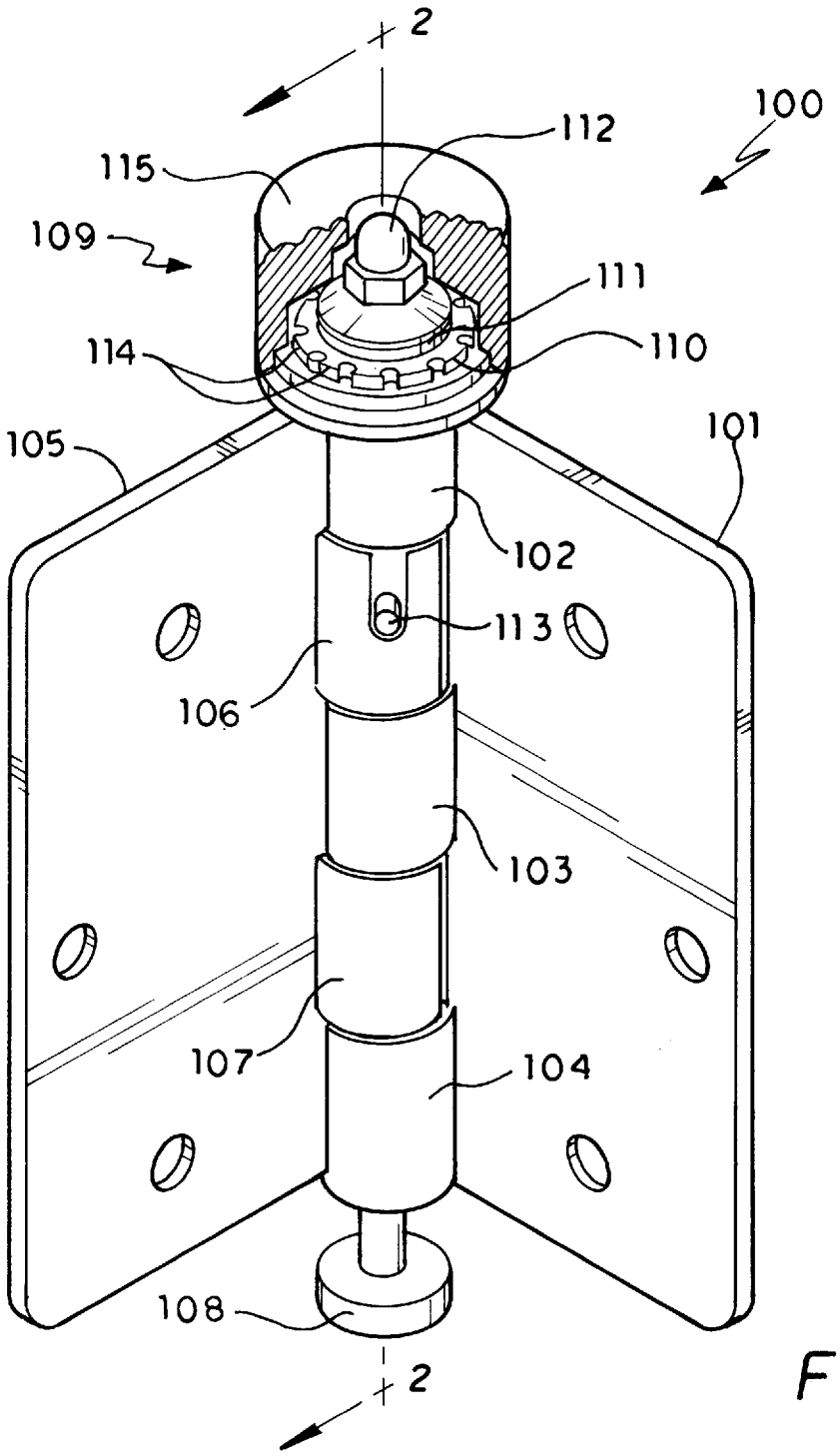
FIG. 1 is a perspective view of the adjustable locking hinge of the present invention, with the cap partially cut away to illustrate the locking mechanism at the top of the hinge in the locked position.
Figure 2:
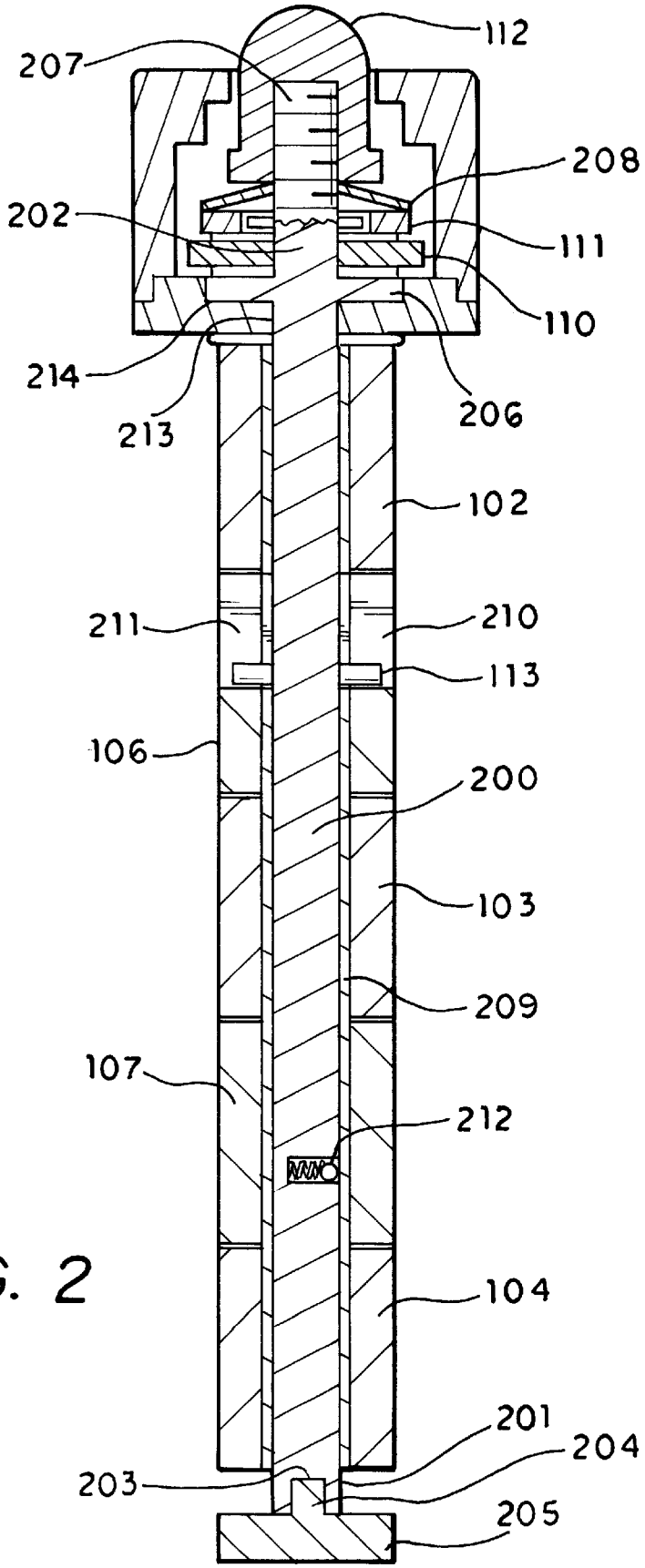
FIG. 2 is a sectional view along line 2—2 of FIG. 1.
Figure 3:
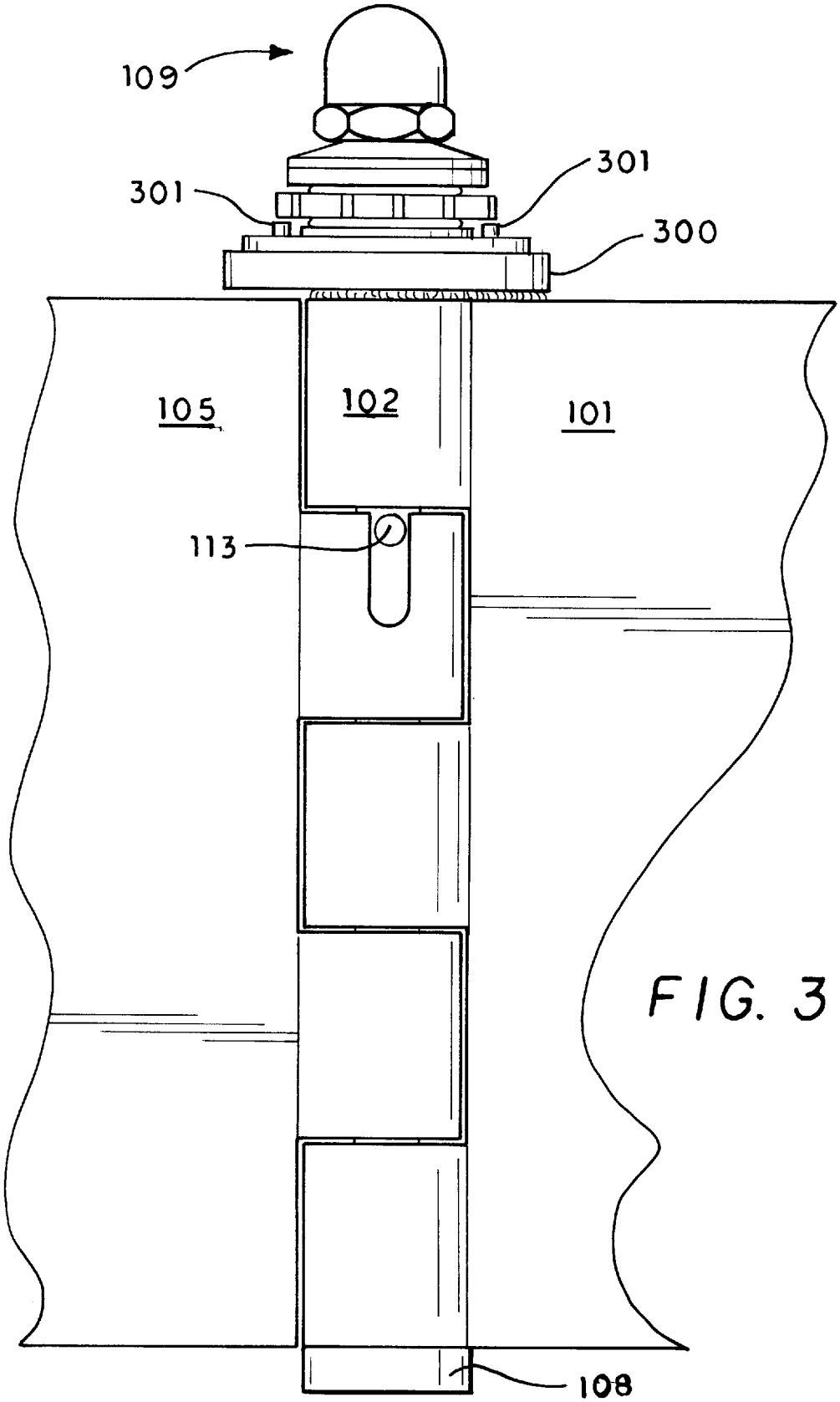
FIG. 3 is a partial front elevational view of the hinge, with the cap removed and the locking mechanism in the unlocked position.

The present invention is an adjustable locking hinge 100 as shown in FIGS. 1–4. The hinge 100 includes a first hinge leaf 101 that has three knuckles 102, 103 and 104, and a second hinge leaf 105 that has two knuckles 106 and 107 in an intermeshing relationship with knuckles 102, 103 and 104. A hinge pin 200 extends through the knuckles 102, 103, 104, 106 and 107, and includes upper 202 and lower 201 portions that extend above and below the knuckles.

Figure 4:
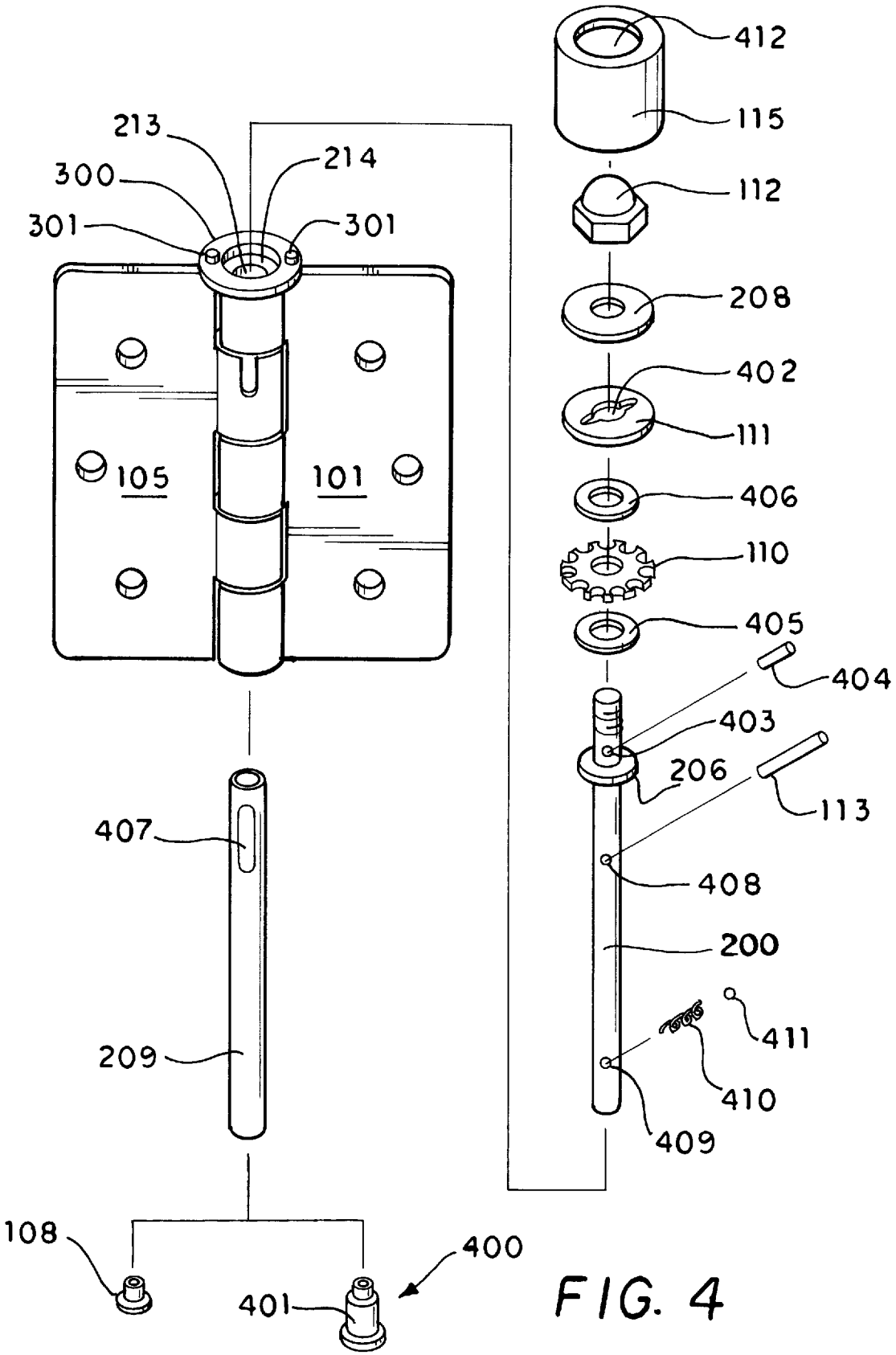
FIG. 4 an exploded perspective view of the adjustable locking hinge of FIG. 1.

The hinge pin lower portion 201 includes an axial bore 203 with an end button 108 press fit therein. End button 108 has a cylindrical portion 204 and a circular plate portion 205. The cylindrical portion 204 has an external diameter that is slightly larger than the internal diameter of the axial bore 203, to provide the press fit therebetween. The circular plate portion 205 has an external diameter that is substantially equal to the external diameters of the knuckles of the first and second leaves, thereby providing a flush surface and limiting the upward travel of hinge pin 200. A second embodiment of the end button is shown in FIG. 4 as 400. End button 400 includes a second cylindrical portion 401, between the first cylindrical portion and the circular plate portion. The second cylindrical portion 401 has an external diameter that is substantially equal to the external diameter of the hinge pin 200, to allow the second cylindrical portion 401 to act as an extension of the hinge pin 200.

A locking mechanism 109 surrounds the hinge pin upper portion 202, and includes a base element 300 that is welded to the top of the first hinge leaf 101 and knuckle 102. The base element 300 has catch means in the form of two pins 301 upstanding from opposite sides of the base element 300. A sprocket plate 110 is mounted on the hinge pin upper portion 202, and is axially shiftable with the hinge pin 200 to the locked and unlocked positions. The sprocket plate 110 includes a plurality of peripheral teeth 114 that form recesses through which pins 301 extend when they engage the sprocket plate 110. In the locked position, the hinge pin 100 is moved downward, and the sprocket plate 110 is engaged by pins 301, and in the unlocked position the hinge pin 200 is moved upwards and the sprocket plate 110 is disengaged from the pins 301. The sprocket plate 110 is supported on the hinge pin 200 by a shoulder portion 206 attached to the upper hinge pin portion 202. A pressure plate 111 is keyed to the hinge pin upper portion 202 above the sprocket plate 110. The center of pressure plate 111 has an elongated aperture 402. A transverse bore 403 extends horizontally through the hinge pin upper portion 202, and a dowel 404 is mounted within the transverse bore 403. The aperture 402 is dimensioned and configured to receive the dowel 404, thereby keying the pressure plate 111 to the hinge pin upper portion 202. Base element 300 further includes a central bore 213 through which the hinge pin 200 extends, and a circular shelf 214 surrounding the central bore 213. The shoulder portion 206 contacts the shelf 214 when the hinge pin 200 is in the lowered, locked position and thereby limits the downward axial shifting of the hinge pin 200 with respect to the base element 300, and the hinge 100.

The sprocket plate 110, is not keyed to the hinge pin upper portion 202, and rotates frictionally with respect to the hinge pin 200. The friction that must be overcome for the sprocket plate 110 to rotate with respect to the hinge pin 200, is adjustable via an actuating mechanism. The hinge pin upper portion 202 includes a threaded section 207, for threadably mounting a hex acorn nut 112 thereon. Between the hex acorn nut 112 and the pressure plate 111 is a spring in the form of a Belleville washer 208. The Belleville washer 208 presses the pressure plate 111 against the sprocket plate 110, thereby applying a biasing force that resists arcuate displacement between the sprocket plate 110 and the pressure plate 111 (as well as the hinge pin 200 which is keyed to the pressure plate 111). By tightening and loosening the hex acorn nut 112 the compression of the Belleville washer 208 is changed thereby adjusting the biasing force that resists arcuate displacement between the sprocket plate 111 and the pressure plate 110. A first fiber washer 405 is mounted between the shoulder portion 206 and the sprocket plate 111 and a second fiber washer 406 is mounted between the sprocket plate 111 and the pressure plate 110. The fiber washers provide a smooth surface between the sprocket plate 111 and the other components of the hinge pin upper portion 202, thereby reducing binding when the sprocket plate 111 rotates relative to the hinge pin 200.

A major advantage of the present invention over prior art devices, is the use of a sleeve 209 that extends through the knuckles 102–104, 106 and 107, of hinge leaves 101 and 105, from the top of knuckle 102 to the bottom of knuckle 104. The sleeve 209 has an external diameter that is slightly larger than the internal diameter of knuckles 106 and 107, and is press fit into knuckles 106 and 107. The internal diameter of knuckles 102–104 is slightly larger than the external diameter of the sleeve 209, to allow rotation therebetween. The hinge pin 200 extends through the sleeve 209 and is nonrotatably fixed relative to the second hinge leaf 105 and the sleeve 209. Knuckle 106 of the second hinge leaf 105 includes two axially extending slots 210 and 211 on opposite sides thereof. The sleeve 209 also includes two axially extending slots 407 that align with the slots 210 and 211 when the sleeve 209 is press fit into knuckles 106 and 107. A transverse bore 408 in the hinge pin 200 receives a dowel 113 that projects into the axially extending slots 407 of the sleeve 209 and the axially extending slots 210 and 211 of the knuckle 106.

As previously explained, the hinge pin 200 is shifted up and down to unlock and lock the hinge 100, respectively. To avoid inadvertent movement of the hinge pin 200, the hinge 100 further includes a position retention mechanism 212. The position retention mechanism 212 includes a transverse bore 409 in the hinge pin 200. Within transverse bore 409, a small coil spring 410 urges a ball bearing 411 against the internal surface of the sleeve 209. This arrangement creates friction between the hinge pin 200 and the sleeve 209 that resists the axial shifting therebetween. In previous designs without sleeve 209, ball bearing 411 "locked" into indentations in the internal surface of knuckle 107. The use of the sleeve 209, however, results in a tighter and more secure fit between the sleeve 209 and the hinge pin 200, and the indentations are therefore unnecessary.

The hinge 100 also includes a protective cap 115 removably attached to the base element 300. The protective cap 115 has a central aperture 412 through which the top portion of the hex acorn 112 extends. This allows the hinge pin 200 to be shifted downward to the locked position by pressing down on the top portion of the hex acorn nut 112. To unlock the hinge 100, the hinge pin 200 is shifted upward to the unlocked position by pressing the end button 108 or 400 upward.

It is to be understood that the present invention is not limited to the embodiments described above, but encompasses any and all embodiments within the scope of the following claims.

I claim:

1. An adjustable locking hinge comprising:

first and second hinge leaves respectively having first and second knuckles in an intermeshing relationship;

a sleeve extending through said first and second knuckles;

a hinge pin extending through said sleeve, said hinge pin having upper and lower portions axially extendible beyond said sleeve and said knuckles, and being axially shiftable with respect to said knuckles and said sleeve;

means nonrotatably fixing said hinge pin relative to said second hinge leaf and said sleeve;

a locking mechanism surrounding said hinge pin upper portion, said locking mechanism including a base element fixed relative to said first hinge leaf;

catch means projecting from said base element;

a sprocket plate disposed above said base element and axially shiftable with said hinge pin to locked and unlocked positions, said sprocket plate being engaged with said catch means in said locked position and released from said catch means in said unlocked position;

a pressure plate keyed to said hinge pin upper portion above said sprocket plate;

spring means adjacent said pressure plate;

actuating means adjustably shiftable on said hinge pin upper portion to variably compress said spring means to apply a biasing force that resists arcuate displacement between said sprocket plate and said pressure plate; and position retention means, said position retention means comprising:

a transverse bore in said hinge pin; and a spring urged ball within said transverse bore, said spring urged ball engaging an interior surface of said sleeve to thereby create friction between said hinge pin and said sleeve, said friction resisting said axial shifting between said hinge pin and said sleeve.

2. The adjustable locking hinge as defined in claim 1, wherein:

said catch means comprises at least one pin upstanding from said base element;

said sprocket plate includes a plurality of peripheral teeth; and said at least one pin engages said teeth in said locked position, and disengages said teeth in said unlocked position.

3. The adjustable locking hinge as defined in claim 2, wherein said at least one pin includes two pins upstanding from opposite sides of said base element.

4. The adjustable locking hinge as defined in claim 3, wherein:

said hinge pin upper portion is threaded; and said actuating means includes a hex acorn nut threadedly attached to said hinge pin upper portion.

5. The adjustable locking hinge as defined in claim 4, wherein:

said spring means is a Belleville washer; and said Belleville washer is located between said pressure plate and said hex acorn nut.

6. The adjustable locking hinge as defined in claim 5, wherein:

said hinge pin upper portion includes a transverse bore:

said adjustable locking hinge further comprises a dowel within said transverse bore;

said pressure plate includes an aperture dimensioned and configured to receive said dowel, said dowel and said aperture thereby keying said pressure plate to said hinge pin upper portion.

7. The adjustable locking hinge as defined in claim 6, wherein:

said hinge pin includes a shoulder portion attached to said upper hinge pin portion;

said base element includes a central bore through which said hinge pin extends, and a shelf surrounding said central bore; and said shoulder portion contacts said shelf when said hinge pin is in said locked position, thereby limiting downward axial shifting of said hinge pin with respect to said base element.

8. The adjustable locking hinge as defined in claim 7, further comprising:

a first fiber washer between said shoulder portion and said sprocket plate; and a second fiber washer between said sprocket plate and said pressure plate.

9. The adjustable locking hinge as defined in claim 8, further comprising a protective cap removably attached to said base element.

10. The adjustable locking hinge as defined in claim 9, wherein:

said protective cap includes a central aperture;

said hex acorn nut includes a top portion extending through said central aperture; and said hinge pin is shifted axially to said locked position when said top portion of said hex acorn nut is pressed downward.

11. The adjustable locking hinge as defined in claim 1, wherein said means nonrotatably fixing said hinge pin relative to said second hinge leaf and said sleeve comprises:

a first axially extending slot in one of said second knuckles of said second hinge leaf;

a second axially extending slot in said sleeve;

a transverse bore in said hinge pin; and a dowel within said transverse bore, said dowel projecting into said first axially extending slot and said second axially extending slot.

12. The adjustable locking hinge as defined in claim 1, wherein:

said second knuckles have an internal diameter;

said sleeve has an external diameter slightly larger than said internal diameter of said second knuckles; and said sleeve is press fit in said second knuckles.

13. An adjustable locking hinge comprising:

first and second hinge leaves respectively having first and second knuckles in an intermeshing relationship;

a sleeve extending through said first and second knuckles;

a hinge pin extending through said sleeve, said hinge pin having an upper portion and a lower portion axially extendible beyond said sleeve and said knuckles, and being axially shiftable with respect to said knuckles and said sleeve, said hinge pin lower portion includes an axial bore having an internal diameter;

an end button press fit in said bore;

means nonrotatably fixing said hinge pin relative to said second hinge leaf and said sleeve;

a locking mechanism surrounding said hinge pin upper portion, said locking mechanism including a base element fixed relative to said first hinge leaf;

catch means projecting from said base element;

a sprocket plate disposed above said base element and axially shiftable with said hinge pin to a locked and an unlocked position, said sprocket plate being engaged with said catch means in said locked position and released from said catch means in said unlocked position;

said hinge pin being shifted axially to said unlocked position when said end button is pressed upward;

a pressure plate keyed to said hinge pin upper portion above said sprocket plate;

spring means adjacent said pressure plate; and actuating means adjustable shiftable on said hinge pin upper portion to variably compress said spring means to apply a biasing force that resists arcuate displacement between said sprocket plate and said pressure plate.

14. The adjustable locking hinge as defined in claim 13, wherein:

said first and second knuckles are generally cylindrical and have substantially equal exterior diameters;

said end button comprises a first cylindrical portion and a circular plate portion;

said first cylindrical portion has an external diameter slightly larger than said internal diameter of said axial bore, to provide a press fit between said first cylindrical portion and said axial bore; and said circular plate portion has an external diameter substantially equal to said exterior diameters of said first and second knuckles.

15. The adjustable locking hinge as defined in claim 14, wherein:

said hinge pin has an external diameter;

said end button further comprises a second cylindrical portion between said first cylindrical portion and said circular plate portion; and said second cylindrical portion has an external diameter substantially equal to said external diameter of said hinge pin.

* * * * *